US005131588A

United States Patent [19]

Oliff

[11] Patent Number: 5,131,588

[45] Date of Patent: Jul. 21, 1992

[54] PANEL INTERLOCK

[75] Inventor: James R. Oliff, Austell, Ga.

[73] Assignee: The Mead Corporation, Dayton, Ohio

[21] Appl. No.: 775,750

[22] Filed: Oct. 15, 1991

[51] Int. Cl.[5] ..... B65D 5/42

[52] U.S. Cl. ..... 229/198.2; 206/427; 229/40

[58] Field of Search ..... 229/40, 194, 195, 198.2; 206/427

[56] References Cited

U.S. PATENT DOCUMENTS

| | | | |
|---|---|---|---|
| 2,872,036 | 2/1959 | Forrer | 229/40 |
| 3,224,630 | 12/1965 | Spery | 229/40 |
| 3,410,397 | 11/1968 | Cato | 229/40 |
| 4,077,095 | 3/1978 | Oliff | 229/40 |
| 4,394,903 | 7/1983 | Bakx | 229/40 |
| 4,440,340 | 4/1984 | Bakx | 229/40 |
| 5,000,313 | 3/1991 | Oliff | 229/40 |

*Primary Examiner*—Gary E. Elkins
*Attorney, Agent, or Firm*—Rodgers & Rodgers

[57] ABSTRACT

For interlocking a pair of panels in overlapping face contacting relation, dual side by side locking tabs are struck from one panel and are arranged to be driven through side by side dual retaining apertures separated from each other by a reinforcing strut which is integrally connected at its ends with the other panel, the reinforcing strut being arranged to occupy the space between the dual retaining apertures.

10 Claims, 2 Drawing Sheets

PANEL INTERLOCK

TECHNICAL FIELD

This invention relates to securing the overlapping ends of a tubular wrapper in which a plurality of articles are packaged.

BACKGROUND ART

U.S. Pat. No. 4,077,095 issued May 1, 1978 and owned by the assignee of this invention discloses and claims panel interlocking means in which a shouldered locking tab struck from one panel is driven through an aperture in another panel defined by a retaining tab together with a securing aperture formed in the base of the locking tab which receives a securing tab projecting form an edge of the locking aperture.

New Zealand patent 191,646 owned by the assignee of this invention discloses locking tabs and retaining tabs wherein a single locking tab struck from one panel is driven through an aperture defined by a pair of retaining tabs struck from another panel and normally disposed in abutting relationship to each other.

U.S. Pat. No. 5,000,313 issued Mar. 19, 1991 and owned by the assignee of this invention discloses a tubular wrapper having overlapping face contacting panels for packaging a plurality of specially shaped cans and in which the wrapper is especially adapted to accommodate cans having inwardly recessed ends.

SUMMARY OF THE INVENTION

According to this invention in one form, a pair of panels are interlocked in overlapping face contacting relation by means of side by side dual locking tabs struck from one of the panels and driven through side by side spaced apart dual retaining apertures formed in the other panel and defined by dual retaining tabs separated by a reinforcing strut interposed between the retaining tabs and arranged with its ends integrally connected with the other panel.

BEST MODE OF CARRYING OUT THE INVENTION

Figures 1, 1A:
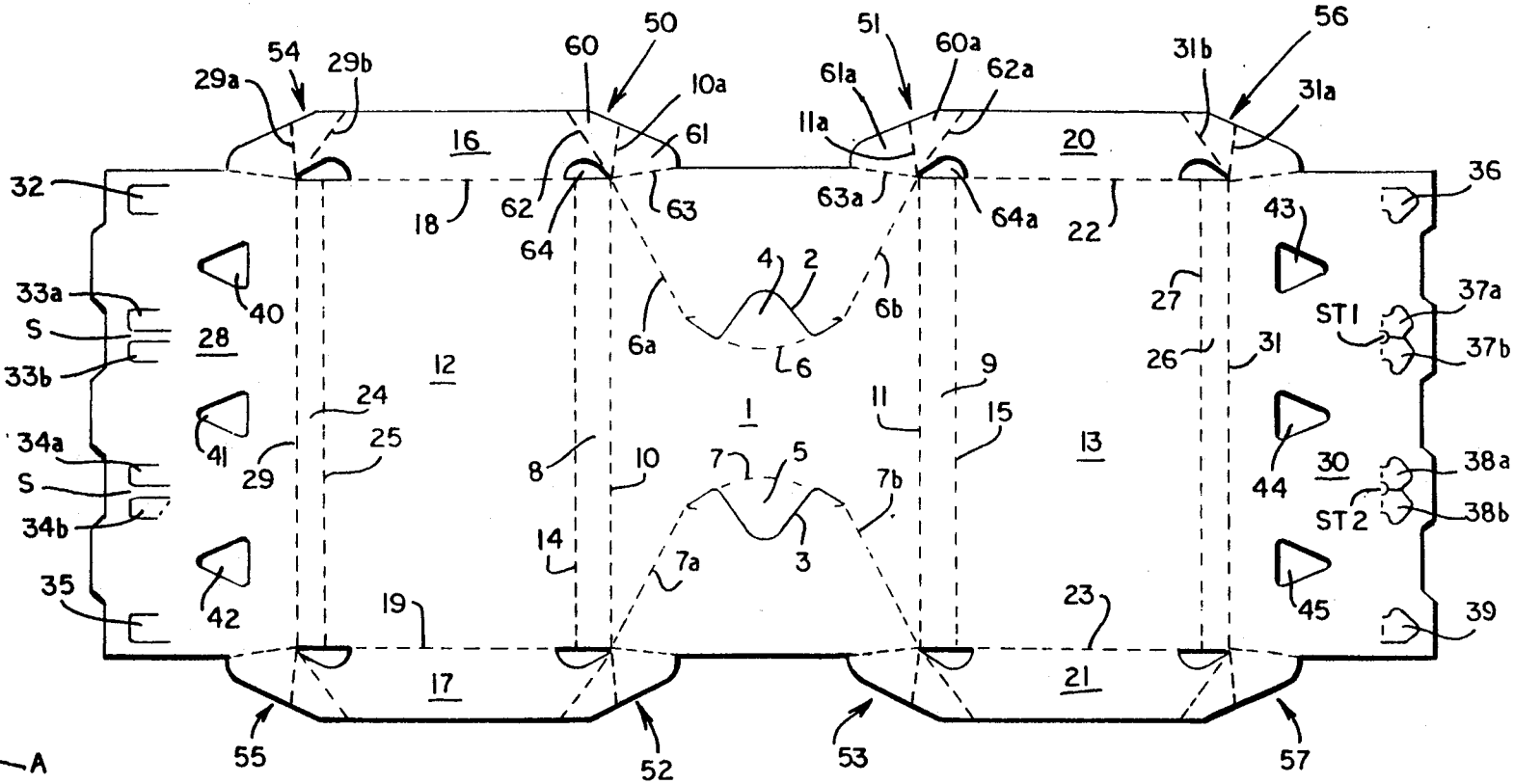
FIG. 1 is a plan view of a carton blank as viewed from the inside.
FIG. 1*a* is an enlarged view of one feature shown on FIG. 1.
Figure 6:
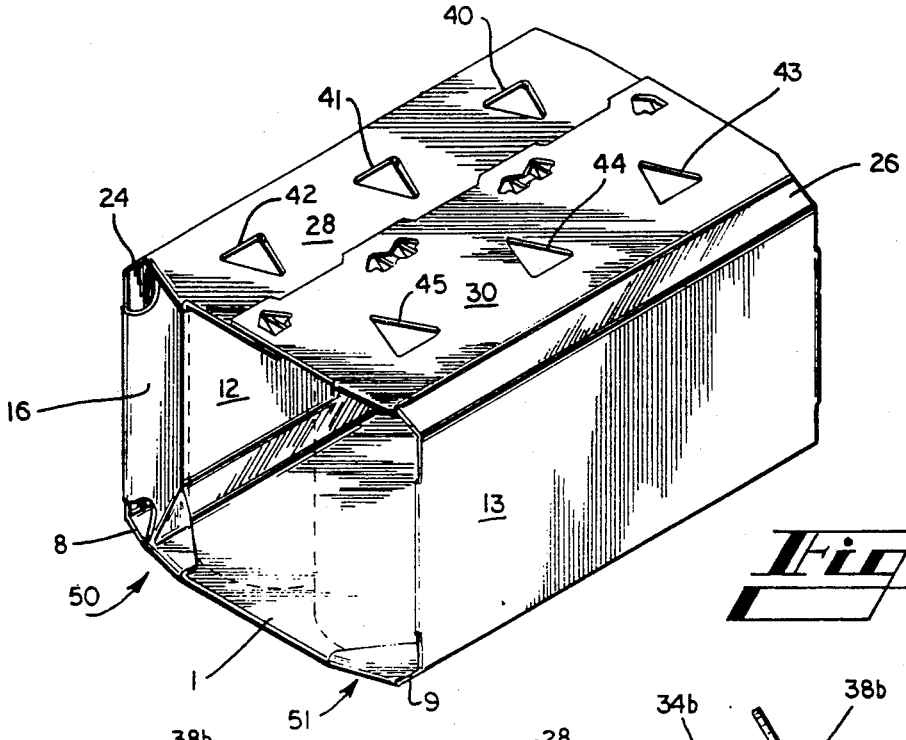
FIG. 6 is a view of a set up carton formed from the blank of FIG. 1 but which shows the carton in an inverted position so as to indicate the disposition of the locking elements formed according to this invention.

With reference primarily to FIG. 1, the numeral 1 designates the carton top wall. A pair of finger receiving apertures 2 and 3 are formed in top wall 1 and are normally closed by tabs 4 and 5 which are foldably joined to top wall 1 along fold lines 6 and 7 respectively. A pair of relief scores 6*a* and 6*b* are formed in association with the finger receiving aperture 2 and which diverge generally toward the top wall corner and similar relief scores 7*a* and 7*b* are also provided. A pair of continuous uninterrupted bevel strips 8 and 9 are foldably joined to top wall 1 along fold lines 10 and 11 respectively. Fold lines 10 and 11 are provided with divergent extensions which are angularly disposed relative to such fold lines and are identified by the references 10*a* and 11*a*. Side walls 12 and 13 are foldably joined to bevel strips 8 and 9 along fold lines 14 and 15 respectively. Anchoring panels 16 and 17 are foldably joined to end edges of side wall 12 along fold lines 18 and 19 respectively while anchoring panels 20 and 21 are foldably joined to the end edges of side wall 13 along fold lines 22 and 23 respectively.

Bevel strip 24 is foldably joined to the bottom edge of side wall 12 along a fold line 25 and bevel strip 26 is foldably joined to the bottom edge of side wall 13 along a fold line 27.

Preferably bevel strips 8 and 9 are slightly wider than bevel strips 24 and 26.

Bottom lap panel 28 is foldably joined to the bottom edge of bevel strip 24 along fold line 29 and bottom lap panel 30 is foldably joined to the bottom edge of bevel strip 26 along fold line 31.

For securing the packaged cans in a composite package group within the carton, the carton blank is placed above a package group and the anchoring panels 16, 17, 20 and 21 are folded inwardly into flat face contacting relation with the adjacent inner surface of side walls 12 and 13 as is obvious. Web structures generally indicated at 50 and 51, 52 and 53 are disposed astride the upper corners of the carton and prevent dislodgement of cans through the ends of the carton as the known folding applications are performed. In like fashion, web structures 54, 55, 56 and 57 are disposed astride the bottom corners of the carton and aid in securing the cans against dislodgement through the ends of the wrapper.

For securing the lap panels 28 and 30 together in overlapping relation, a plurality of dual retaining tabs 33*a*, 33*b*, 34*a*, 34*b* and single retaining tabs 32 and 35 are struck from lap panel 28 to define apertures for respectively receiving dual locking tabs 37*a*, 37*b*, 38*a*, 38*b* and single locking tabs 36 and 39 which are struck from lap panel 30. These locking tabs are driven through the openings defined in the retaining tabs after the blank is securely tightened about a group of packaged cans by means of machine elements which enter tightening apertures 40, 41 and 42 formed in lap panel 28 and by similar machine tightening elements which enter apertures 43, 44 and 45 formed in lap panel 30 and which are drawn inwardly in opposition to each other to tighten the blank about a package group before locking of the lap panels 28 and 30 together in flat face contacting relation to form a composite bottom wall of the carton in a manner well known in the art.

Each web structure comprises a pair of web panels such as 60, 61 and 60*a*, 61*a* which are foldably joined together by divergent extensions 10*a* and 11*a* respectively which diverge inwardly by an angle which corresponds generally with the angle of taper of the inwardly inclined upper portions of the side wall. One web panel 60 is foldably joined to an end of anchoring panel 16 along fold line 62 and another web panel 60*a* is foldably joined to anchoring panel 20 along fold line 62*a*. Web panel 61 is foldably joined to top wall 1 along fold line 63 which is disposed tangentially to the top of the can. Web panel 61*a* is foldably joined to top wall 1 along fold line 63*a*. Fold lines 62 and 63 and fold lines 62*a* and 63*a* are preferably disposed at an angle of 120 degrees to each other. A cutaway area designated by the numeral 64 serves to isolate the web panel 60 from the bevel strip 8 and cutaway area 64*a* isolates the web panel 60*a* from bevel strip 9. Web structure according to that described in conjunction with web structures 50 and 51 also forms web structures 52–57 as is obvious.

Fold lines 29*a* and 31*a* correspond to fold lines 10*a* and 11*a* respectively and folds 29*b* and 31*b* correspond to fold lines 62 and 62*a*.

When the wrapper of FIG. 1 is disposed about a can group, the web structures such as 50, 51, 54 and 56 are disposed astride the carton corners and securely grip the packaged cans and prevent dislodgement of the cans through the adjacent end of the carton. Similar web structures 52, 53, 55 and 57 secure the opposite end of the carton.

According to this invention, the security of the interlocking arrangement between face contacting overlapping panels is greatly enhanced due to the cooperation of dual locking elements such as locking tabs 37*a*, 37*b* and 38*a* and 38*b* each having a base and spaced sides and which are driven through spaced apart dual retaining apertures defined by dual retaining tabs 33*a*, 33*b* and 34*a* and 34*b* separated by reinforcing struts S.

Figure 5:
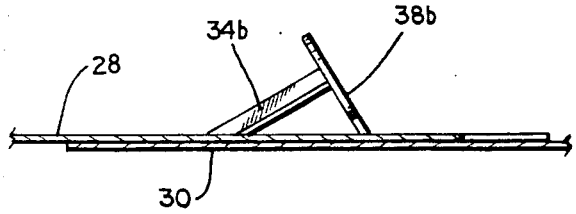
FIGS. 2, 3, 4 and 5 depict locking and retaining tabs formed according to this invention and which show the structure in progressive stages of the formation of an interlocked relationship between a pair of overlapping panels.
Figure 4:
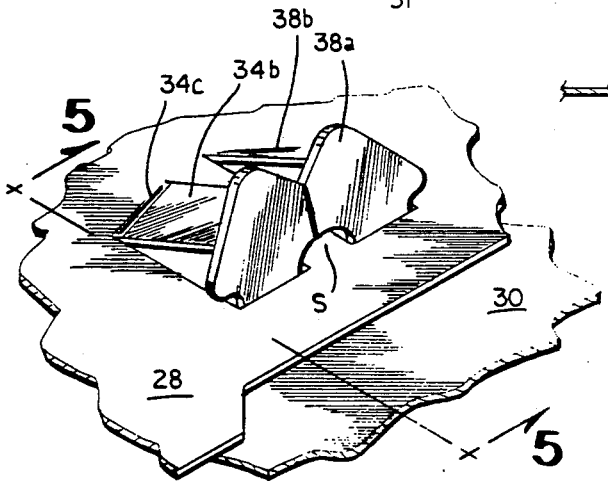
Figure 3:
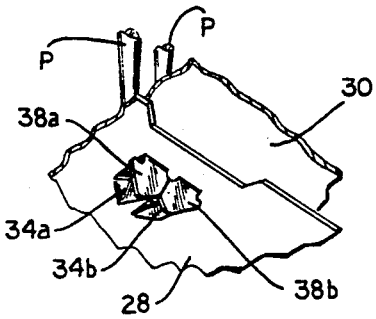
Figure 2:
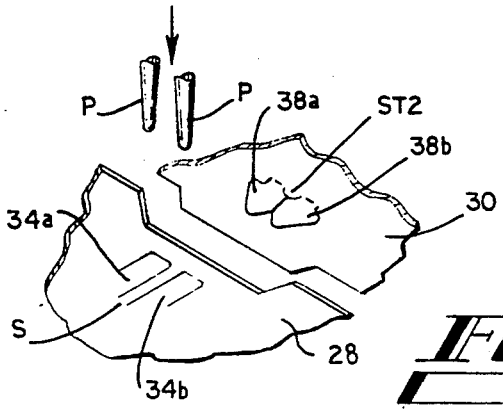

FIG. 2 shows panels 28 and 30 and securing tab ST2 prior to the start of a locking operation. The securing tabs ST1 and ST2 allow lock clearing engagement of the locks and are disposed in contact with the adjacent end of the reinforcing strut S. FIG. 3 shows the panels 28 and 30 from the inside of the carton after they are interlocked. FIG. 4 shows the structure enlarged and like FIG. 5 shows retaining tab 34*b* propped against locking tab 38*b*. FIG. 4 shows reinforcing strut S and shows retaining tab 34*b* folded out of panel 28 along a fold line 34*c* which is formed by the difference in length of the sides of reinforcing tab 34*b*. Also the angle A such as is shown in FIG. 1*a* is an acute angle and causes the retaining tab 34*b* and other such tabs to reside at an angle to the reinforcing strut S and to panel 28. The shoulders of locking tabs such as 37*a* and 37*b* are disposed in abutting relation.

One advantage of this structure is that it improves the tensile strength of the locked panels by some substantial amount as indicated by tests performed in developing this structure. Another advantage of this invention is that the machine for driving the dual locking tabs into the dual spaced apart locking apertures is easy to provide since a single rotary wheel may be provided with two locking plungers P at each locking position by simple procedures utilizing well established known locking machine elements. Another advantage achieved by this invention is the fact that the locking tabs are constructed in such a way that they penetrate the locking apertures more easily due to the angular disposition of the retaining tabs which are adjoined to their associated panel by fold lines which diverge at an acute angle to the reinforcing strut which is disposed between the dual locking apertures.

I claim:

1. An arrangement for interlocking a pair of panels in overlapping face contacting relation, said arrangement comprising side by side dual locking tabs each having a base and spaced sides with adjacent shoulders projecting laterally from its sides and disposed i abutting relation to each other and being struck from one of said panels and each being foldably joined at its base to said one panel, and side by side spaced apart dual retaining tabs struck from the other of said panels and defining locking apertures having side edges of predetermined fixed length and which are formed in said other of said panels, each retaining tab having a base and side and end edges and being foldably joined at its base to said other of said panels and being disposed in abutting relation with one of said locking tabs so as to secure said one locking tab in angular relation to said panels and to aid in holding said panels in face contacting relation following movement of each of said locking tabs through the associated locking aperture.

2. An arrangement according to claim 1 wherein a reinforcing strut having parallel side edges and having ends which are integral with the other of said panes is interposed between said retaining tabs and integrally connected at its ends with said other of said panels.

3. An arrangement according to claim 2 wherein a securing tab is formed integrally with said one panel and interposed between base portions of said dual locking tabs.

4. An arrangement according to claim 3 wherein said securing tab is disposed in overlying relation with said reinforcing strut.

5. An arrangement according to claim 2 wherein adjacent side edges of said dual retaining tabs define opposite side edges of said reinforcing strut.

6. An arrangement according to claim 5 wherein said dual retaining tabs include side edges which are opposite from said parallel side edges of said reinforcing strut and are shorter than said side edges of said reinforcing strut.

7. An arrangement according to claim 6 wherein each of said dual retaining tabs folds inwardly along a fold line disposed at an acute angle to a side edge of said reinforcing strut when the corresponding dual locking tabs are driven inwardly.

8. An arrangement according to claim 7 wherein the end edge of each of said retaining tabs is disposed in abutting relation with the associated locking tab.

9. An arrangement according to claim 3 wherein said securing tab is struck from adjacent portions of said locking tabs.

10. An arrangement according to claim 9 wherein said reinforcing strut includes an inner surface and wherein adjacent shoulders of said locking tabs overlie the inner surface of said reinforcing strut.

* * * * *